US011812792B2

(12) United States Patent
Liu

(10) Patent No.: US 11,812,792 B2
(45) Date of Patent: Nov. 14, 2023

(54) ELECTRONIC CIGARETTE HAVING A PLATE WITH A PNEUMATIC SWITCH AND A CHARGING PLATE

(71) Applicant: Shenzhen Eigate Technology Co., Ltd., Shenzhen (CN)

(72) Inventor: Tuanfang Liu, Shenzhen (CN)

(73) Assignee: SHENZHEN EIGATE TECHNOLOGY CO., LTD., Shenzhen (CN)

( * ) Notice: Subject to any disclaimer, the term of this patent is extended or adjusted under 35 U.S.C. 154(b) by 392 days.

(21) Appl. No.: 17/037,772

(22) Filed: Sep. 30, 2020

(65) Prior Publication Data

US 2021/0360980 A1 Nov. 25, 2021

(30) Foreign Application Priority Data

May 21, 2020 (CN) ..... 202010434271.3
May 21, 2020 (CN) ..... 202020883904.4

(51) Int. Cl.

| | |
|---|---|
| ***A24F 40/95*** | (2020.01) |
| ***A24F 40/48*** | (2020.01) |
| *A24F 40/70* | (2020.01) |
| *A24F 40/10* | (2020.01) |

(52) U.S. Cl.
CPC ..... *A24F 40/95* (2020.01); *A24F 40/48* (2020.01); *A24F 40/10* (2020.01); *A24F 40/70* (2020.01)

(58) Field of Classification Search
CPC ..... A24F 40/95; A24F 40/51; A24F 40/48; A24F 40/40
See application file for complete search history.

(56) References Cited

U.S. PATENT DOCUMENTS

2020/0008466 A1* 1/2020 Ouyang ..... H05B 1/0297
2020/0008479 A1* 1/2020 Ouyang ..... G01L 9/0041
2021/0367219 A1* 11/2021 Liu ..... H01M 50/247

* cited by examiner

*Primary Examiner* — Hae Moon Hyeon
(74) *Attorney, Agent, or Firm* — MATTHIAS SCHOLL P.C.; Matthias Scholl

(57) ABSTRACT

An electronic cigarette including an atomization assembly and a battery assembly. The atomization assembly is disposed on the battery assembly. The battery assembly includes an air column and a plate including a pneumatic switch. When in use, airflow passes through the air column to drive the plate including the pneumatic switch to work. The air column and the plate are disposed on the top end of the battery assembly, and the air column is staggered with the plate thus preventing an e-liquid from flowing onto the plate.

5 Claims, 6 Drawing Sheets

ELECTRONIC CIGARETTE HAVING A PLATE WITH A PNEUMATIC SWITCH AND A CHARGING PLATE

CROSS-REFERENCE TO RELATED APPLICATIONS

Pursuant to 35 U.S.C. § 119 and the Paris Convention Treaty, this application claims foreign priority to Chinese Patent Application No. 202010434271.3 filed on May 21, 2020, and to Chinese Patent Application No. 202020883904.4 filed on May 21, 2020. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an electronic cigarette.

A conventional electronic cigarette comprises an air column and a pneumatic switch. When airflow passes through the air column, the pneumatic switch is driven by the airflow to work. The air column is vertically aligned with the pneumatic switch, and the e-liquid may flow to the pneumatic switch thus causing short circuit.

SUMMARY

The disclosure provides an electronic cigarette comprising an atomization assembly and a battery assembly; the atomization assembly is disposed on the battery assembly; the battery assembly comprises an air column and a plate comprising a pneumatic switch; when in use, an airflow passes through the air column to drive the plate comprising the pneumatic switch to work; the air column and the plate are disposed on a top end of the battery assembly, the plate is disposed along a vertical plane, and the air column is spaced apart from the plate by a first distance along a direction perpendicular to the vertical plane thus preventing an e-liquid from flowing onto the plate.

In a class of this embodiment, the battery assembly further comprises a first silicone gasket and a support; the air column is disposed on one side of a top end of the support; the plate comprising the pneumatic switch is disposed in the first silicone gasket; the first silicone gasket is disposed in the support and spaced apart from the air column by a second distance along a direction perpendicular to the vertical plane.

In a class of this embodiment, the battery assembly further comprises a charging plate; the charging plate comprises a steel sheet and a thimble soldered on the steel sheet.

In a class of this embodiment, the thimble is three in number and is soldered on an epsilon-type nickel steel sheet by laser welding technology.

In a class of this embodiment, the battery assembly further comprises a support, a battery, and a magnet; the charging plate is disposed on a bottom end of the support; the three thimbles on the charging plate run through the support to connect to contacts of a charging unit; the magnet is disposed on the bottom end of the support to attract the charging unit when the battery assembly is being charged; the battery is fixed in the support and positive and negative terminals of the battery are soldered on the charging plate.

The electronic cigarette is placed in a battery box in nonuse for benefit of charging and carrying.

DETAILED DESCRIPTION

To further illustrate, embodiments detailing an electronic cigarette are described below. It should be noted that the following embodiments are intended to describe and not to limit the disclosure.

Figure 1:
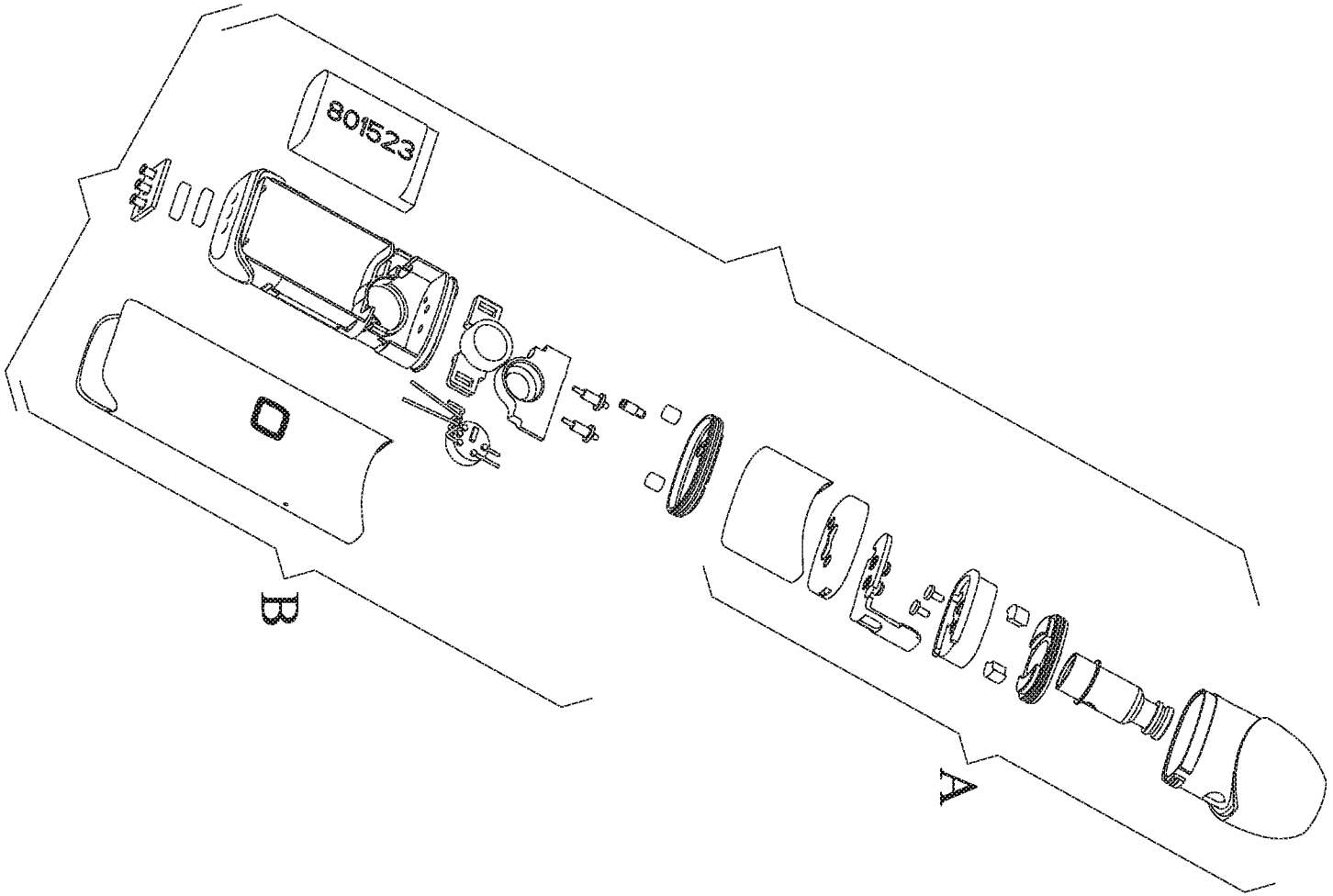
FIG. 1 is an exploded view of an electronic cigarette in accordance with one embodiment of the disclosure.
Figure 2:
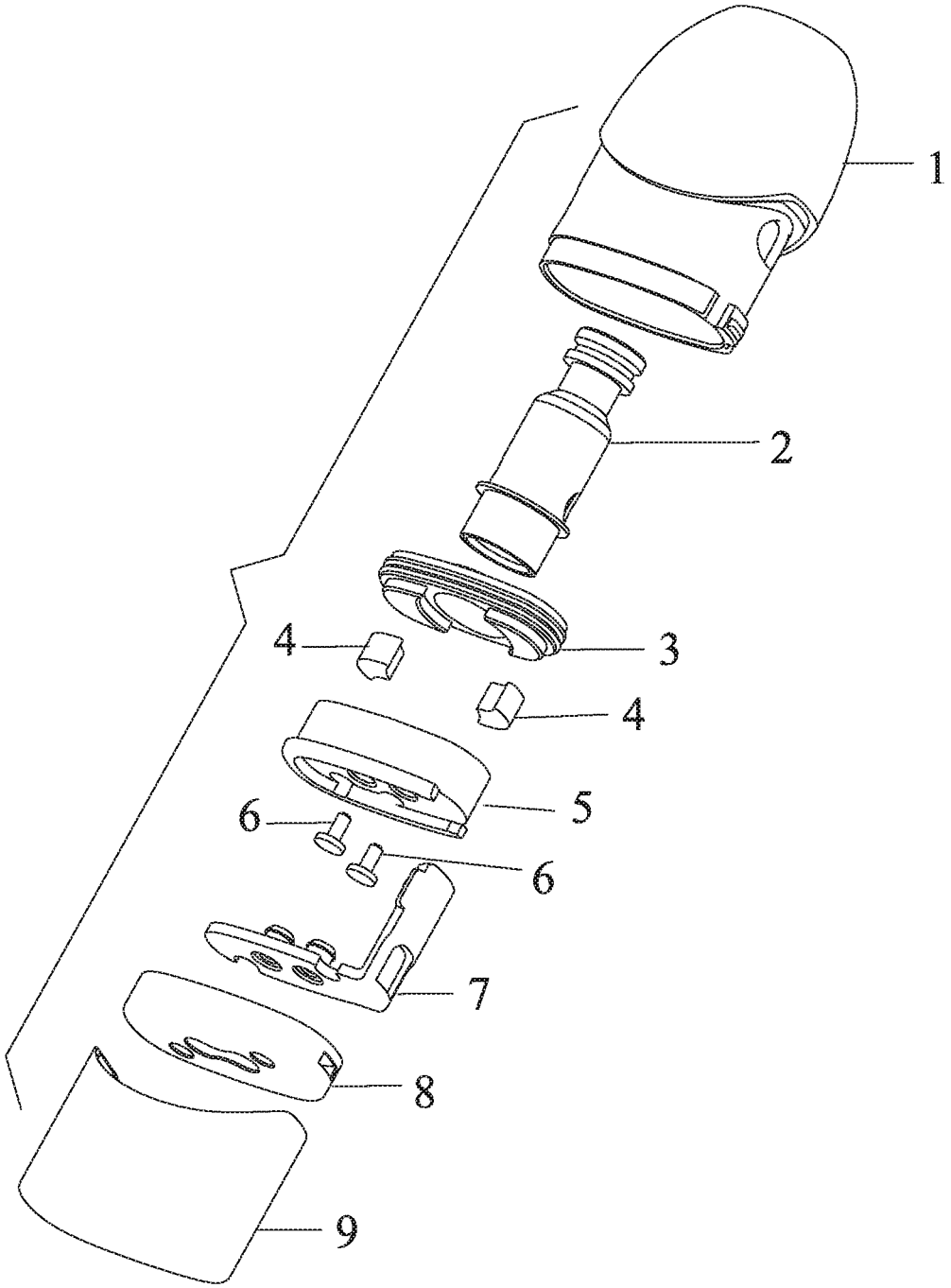
FIG. 2 is an exploded view of an atomization assembly of an electronic cigarette in FIG. 1.
Figure 3:
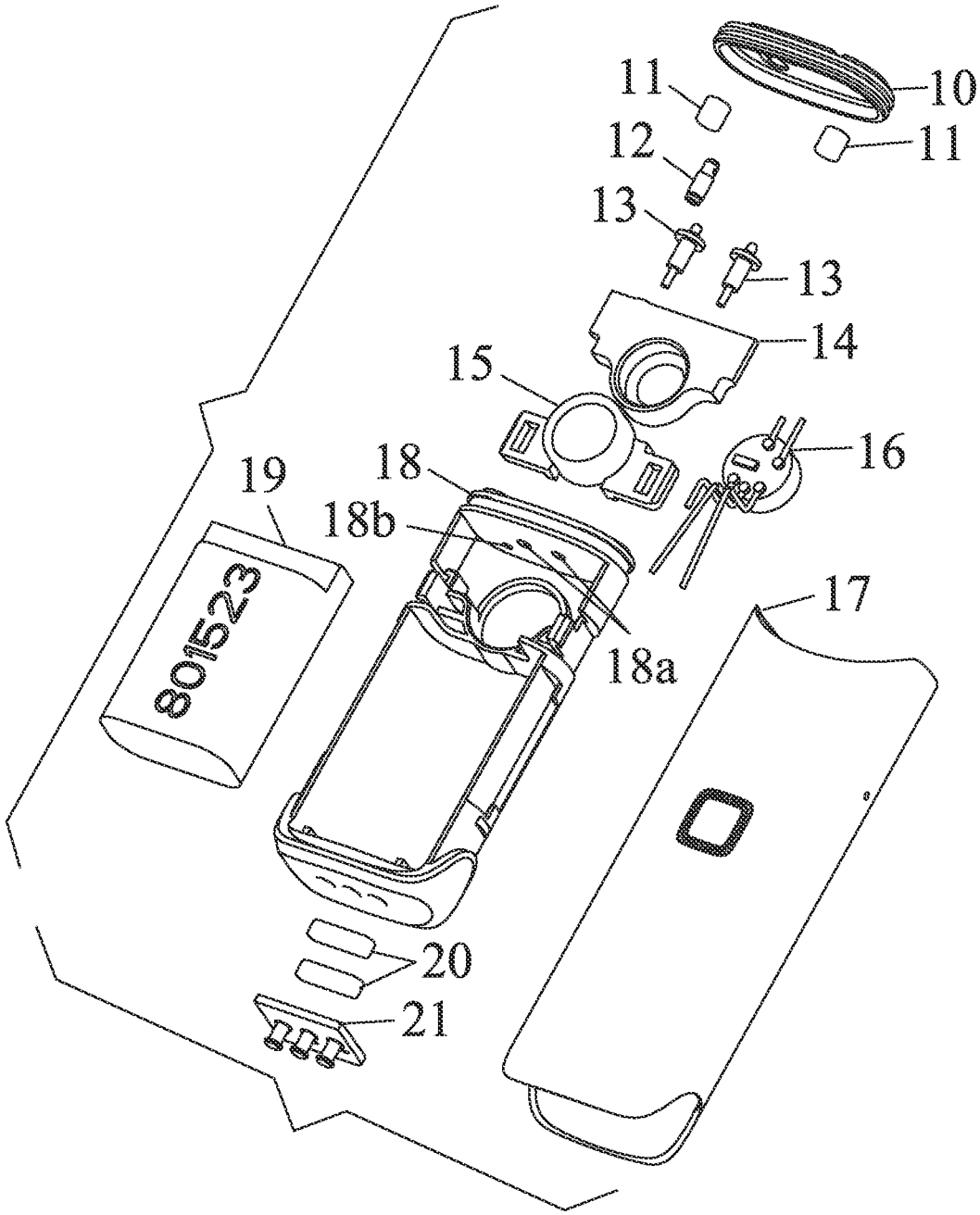
FIG. 3 is an exploded view of a battery assembly of an electronic cigarette in FIG. 1.
Figure 4:
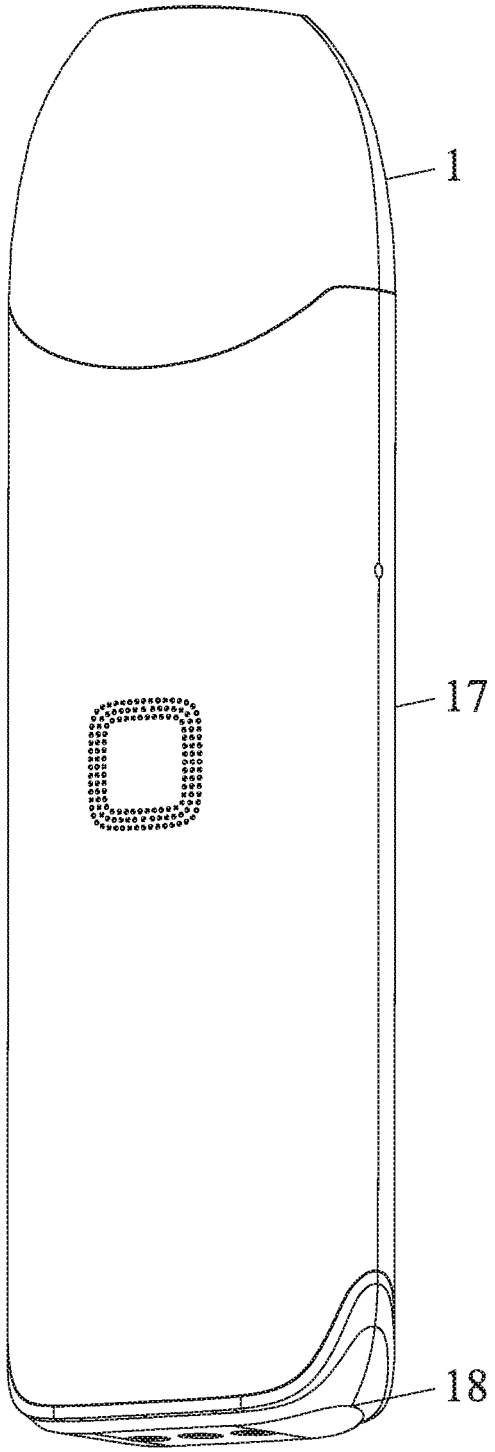
FIG. 4 is a schematic diagram of an electronic cigarette in accordance with one embodiment of the disclosure.
Figure 5:
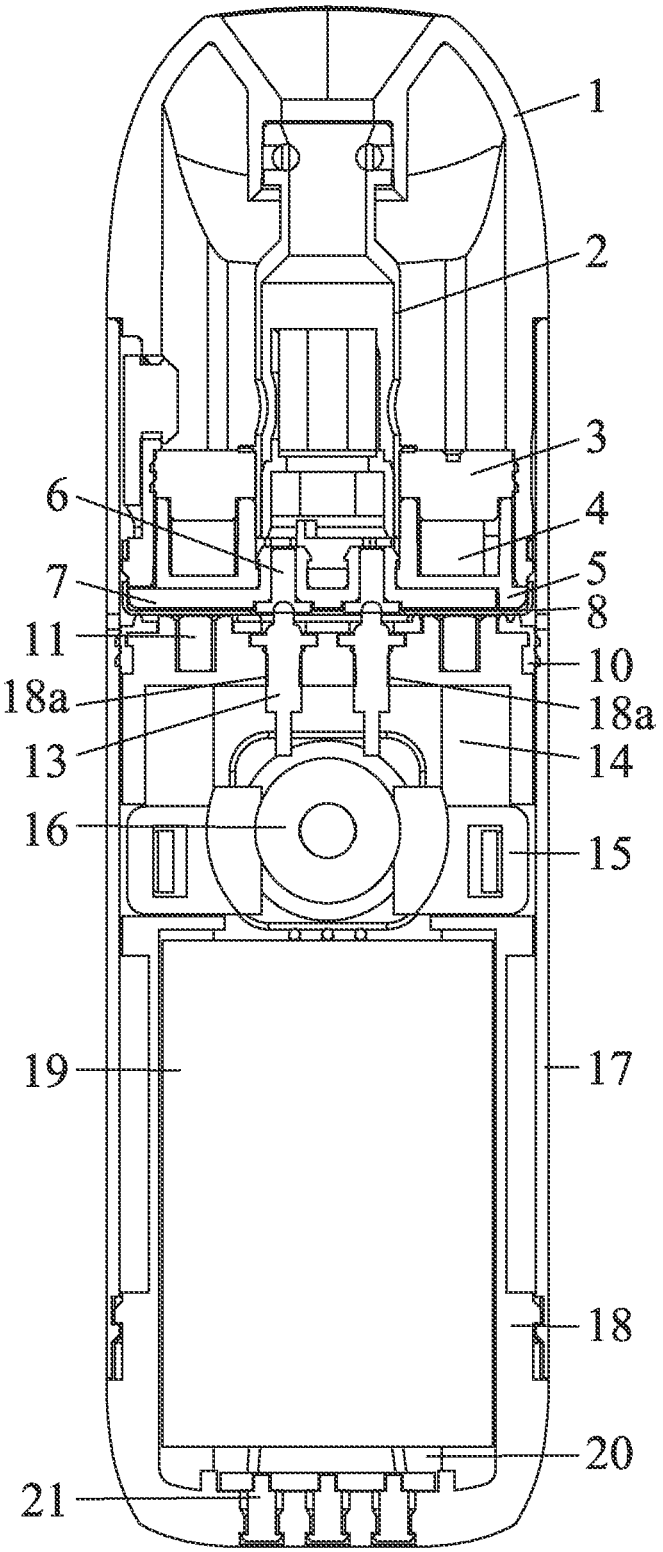
FIG. 5 is a sectional view of an electronic cigarette in accordance with one embodiment of the disclosure.
Figure 6:
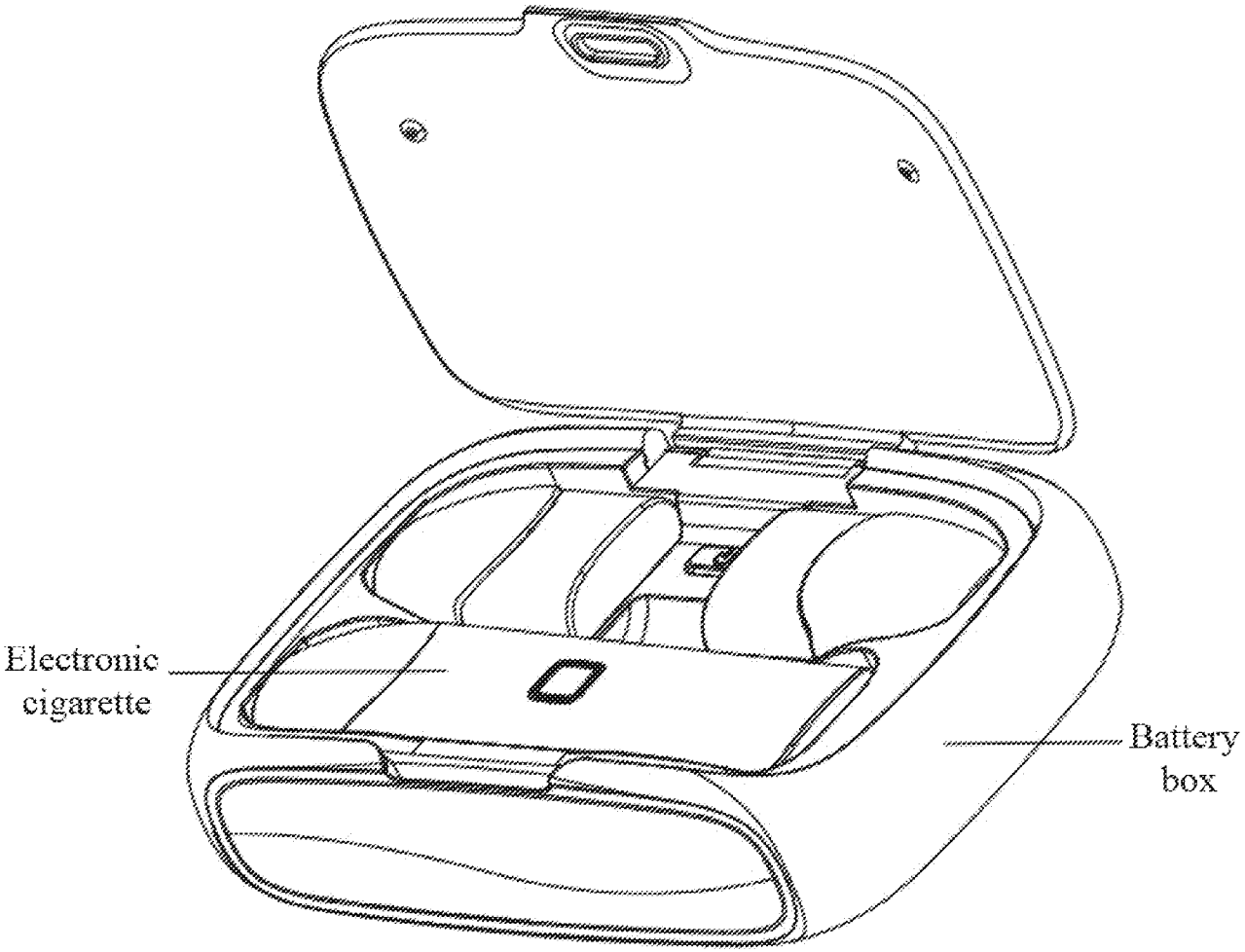
FIG. 6 shows an electronic cigarette placed in a battery box in accordance with one embodiment of the disclosure.

As shown in FIGS. 1-3, the disclosure provides an electronic cigarette comprising an atomization assembly A and a battery assembly B. The atomization assembly A is disposed on the battery assembly B.

The atomization assembly A comprises an e-liquid tank 1, an atomizer 2, a seal gasket 3, two strips of cotton 4, an end cover 5, an electrode pair 6, a seal plug 7, an iron casing 8, and a sheath 9. The atomizer 2 is vertically disposed on the seal gasket 3. The two strips of cotton 4 are disposed in two ends of the end cover 5, respectively. The seal gasket 3 is disposed on the top end of the end cover 5. The seal plug 7 is disposed on the bottom end of the end cover 5. The electrode pair 6 is disposed on the seal plug 7. The end cover 5 is disposed in the e-liquid tank 1. The iron casing 8 is disposed on the bottom end of the e-liquid tank 1. The sheath 9 is disposed around the bottom end of the e-liquid tank 1.

The battery assembly B comprises a seal ring 10, a first magnet 11, an air column 12, a spring pin 13, a first silicone gasket 14, a second silicone gasket 15, a plate 16 comprising a pneumatic switch, a housing 17, a support 18, a battery 19, a second magnet 20, and a charging plate 21. The seal ring 10 is disposed on the support 18. The spring pin 13 is disposed on the top end of the support 18 through a through hole 18*a* for electric conduction. The first magnet 11 is disposed on two sides of the top end of the support 18 and attracts the iron casing of the atomization assembly. The air column 12 is disposed on one side of the top end of the support 18 through a through hole 18*b* for air conduction. The plate 16 is disposed in the first silicone gasket 14 along a vertical plane. The first silicone gasket 14 is disposed in the support 18 and is spaced apart from the air column 12 by a distance along a direction perpendicular to the vertical plane thus preventing an e-liquid from flowing onto the plate 16. The second silicone gasket 15 is disposed on the plate 16 to converge the light of the LED indicator on the plate 16. The charging plate 21 is disposed on the bottom end of the support 18; three thimbles are disposed on the charging plate 21 and run through the support 18 to connect to the contacts of a charging unit. The second magnet 20 is disposed on the bottom end of the support 18. The battery 19 is fixed in the support 18 and positive and negative terminals of the battery are soldered on the input end of the charging plate. The input wire of the plate 16 is soldered on the positive and negative terminals of the battery. The support 18 is disposed in the housing 17.

The support 18 is disposed in the housing 17.

The following advantages are associated with the electronic cigarette of the disclosure:

1. The electronic cigarette comprises the air column and the plate which are disposed on the top end of the battery assembly, the plate is disposed along a vertical plane, and the air column is spaced apart from the plate by a distance along a direction perpendicular to the vertical plane, thus preventing an e-liquid from flowing onto the plate.
2. The battery assembly comprises the charging plate comprising the steel sheet and three thimbles soldered on the epsilon-type nickel steel sheet by laser welding technology.
3. The charging plate comprises the second magnet disposed on the bottom end of the support to attract the charging unit when the battery assembly is being charged.

It will be obvious to those skilled in the art that changes and modifications may be made, and therefore, the aim in the appended claims is to cover all such changes and modifications.

What is claimed is:

1. An electronic cigarette, comprising an atomization assembly and a battery assembly; wherein:

the atomization assembly is disposed on the battery assembly;

the battery assembly comprises an air column, a support, and a switch plate comprising a pneumatic switch;

the switch plate is disposed in the support along a vertical plane;

the air column is disposed on one side of a top end of the support;

when in use, an airflow passes through the air column to drive the switch plate to work;

the air column and the switch plate are disposed on a top end of the battery assembly, and the air column is spaced apart from the switch plate by a first distance along a direction perpendicular to the vertical plane thus preventing an e-liquid from flowing from through the air column onto the switch plate.

2. The electronic cigarette of claim 1, wherein the battery assembly further comprises a first silicone gasket; the switch plate is disposed in the first silicone gasket; the first silicone gasket is disposed in the support and spaced apart from the air column by a second distance along a direction perpendicular to the vertical plane.

3. The electronic cigarette of claim 1, wherein the battery assembly further comprises a charging plate; the charging plate comprises a steel sheet and a thimble soldered on the steel sheet.

4. The electronic cigarette of claim 3, wherein the thimble is three in number and is soldered on an epsilon-type nickel steel sheet by laser welding technology.

5. The electronic cigarette of claim 4, wherein the battery assembly further comprises a support, a battery, and a magnet; the charging plate is disposed on a bottom end of the support; the three thimbles on the charging plate run through the support; the magnet is disposed on the bottom end of the support to attract the charging unit when the battery assembly is being charged; the battery is fixed in the support and positive and negative terminals of the battery are soldered on the charging plate.

* * * * *